United States Patent [19]

Korte

[11] Patent Number: 4,489,866

[45] Date of Patent: Dec. 25, 1984

[54] BACKPACK WITH IMPROVED COMFORT STRUCTURE

[75] Inventor: Gerald A. Korte, Brookfield, Wis.

[73] Assignee: Diamond Brand Canvas Products Co., Inc., Naples, N.C.

[21] Appl. No.: 552,109

[22] Filed: Nov. 16, 1983

Related U.S. Application Data

[63] Continuation-in-part of Ser. No. 273,258, Jun. 12, 1981, abandoned.

[51] Int. Cl.[3] ..... A45F 4/02

[52] U.S. Cl. ..... 224/155; 224/211; 297/25

[58] Field of Search ..... 224/211, 151, 153, 155, 224/156; 297/24, 25, 26, 56, 57, 129

[56] References Cited

U.S. PATENT DOCUMENTS

| | | | |
|---|---|---|---|
| D. 228,043 | 7/1973 | Sloop . | |
| 1,039,078 | 9/1912 | Arnold . | |
| 1,479,769 | 1/1924 | Yamanishi . | |
| 1,615,159 | 1/1927 | Bonner . | |
| 2,031,119 | 2/1936 | Moreland . | |
| 2,843,185 | 7/1958 | Clem et al. . | |
| 2,922,465 | 1/1960 | Johansson et al. . | |
| 2,973,888 | 3/1961 | Beardsley . | |
| 3,250,449 | 5/1966 | Woodman . | |
| 3,292,830 | 12/1966 | Mack . | |
| 3,315,856 | 4/1967 | Black . | |
| 3,733,017 | 5/1973 | Pletz | 224/211 |
| 3,822,422 | 7/1974 | Buntyn . | |
| 3,912,138 | 10/1975 | Pava . | |
| 4,044,931 | 8/1977 | Catelli . | |
| 4,307,826 | 12/1981 | Stewart | 224/211 |

FOREIGN PATENT DOCUMENTS

| | | | |
|---|---|---|---|
| 796458 | 4/1936 | France | 297/25 |
| 1194851 | 6/1970 | United Kingdom | 224/155 |

*Primary Examiner*—Stephen Marcus
*Assistant Examiner*—David Voorhees
*Attorney, Agent, or Firm*—William E. Mouzavires

[57] ABSTRACT

The siderails of a backpack frame form a pair of legs which in turn pivotally support a pair of supplemental legs. The two pair of legs are provided with feet, and when the leg pairs are pivotally opened, a chair is formed. The two pivotally mounted legs on each side of the chair are joined by connector elements which provide for a plurality of adjustments of the distance between the front and rear feet. The pack body is joined to the top cross-bar which joins the main frame siderails. When the device is pivoted to the prone chair position, the pack body is hinged rearwardly on the cross-bar so that its bottom end rests on the ground. The top end of the pack body then is disposed outwardly from the cross-bar to form a pillow for the user. An auxiliary pillow may be attached adjacent the top end of the pack body, and which is swingable forwardly to between the cross-bar and the hiker's head for protective purposes and as a head support during actual hiking. The connector elements may remain joined between the side legs when the device is collapsed. A pack body support extends transversely between and may be joined to the connector elements or the supplemental legs. The support extends behind or through the upper rear portion of the pack body, farthest from the hiker's body, and transfers rearwardly and downwardly directed load forces in that area to the hiker's hips. A second transverse support may extend between the connnector elements upon which the bottom end of the pack body rests. The connector elements furthermore provide for pivoting adjustment of the collapsed device to compensate for a change in load during hiking so that the frame more nearly conforms to the hiker's body.

6 Claims, 9 Drawing Figures

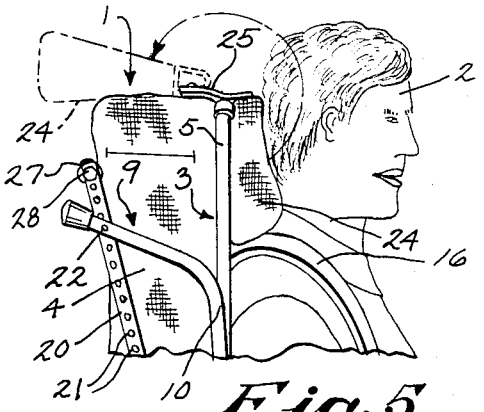
Fig. 5
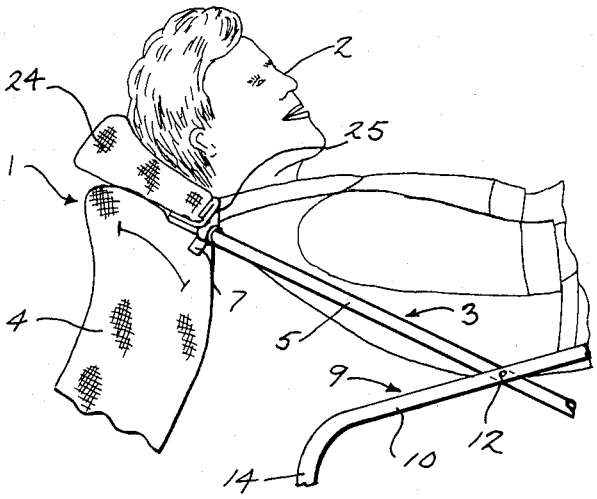
Fig. 6
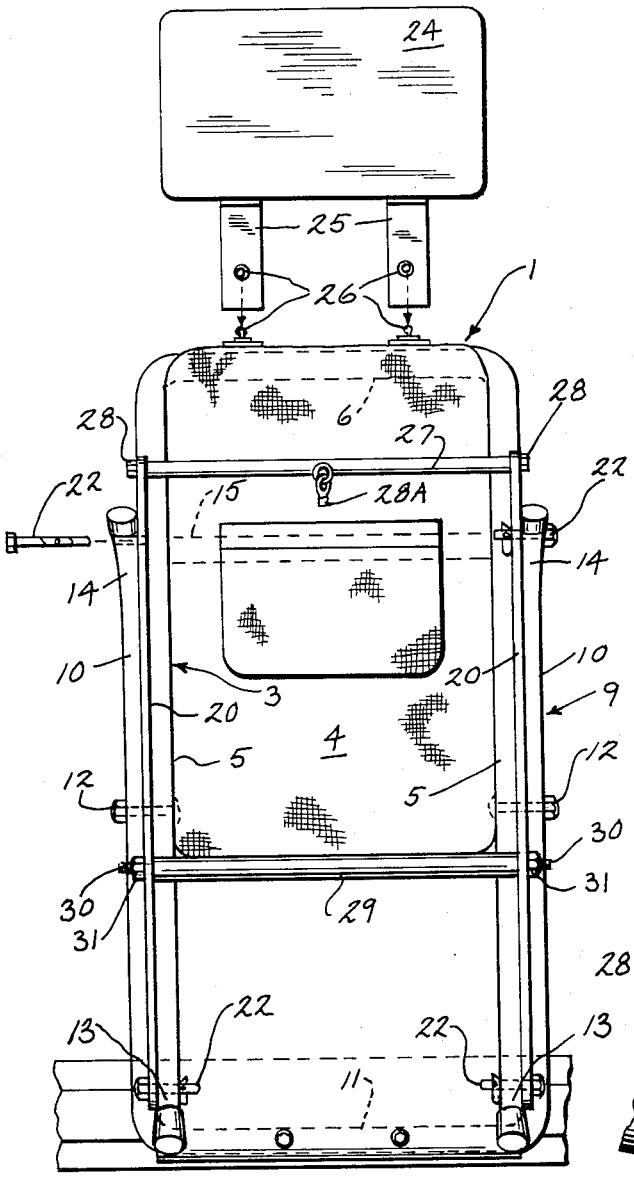
Fig. 7
Fig. 8
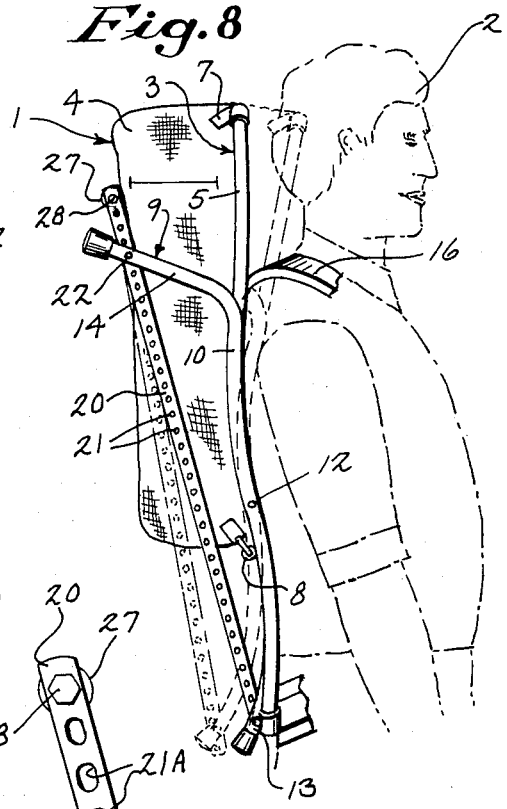
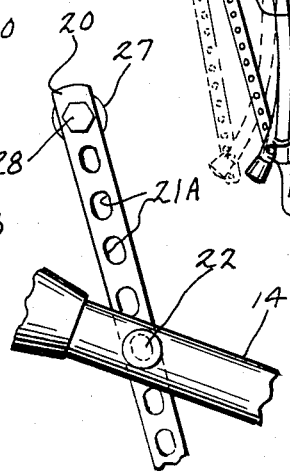
Fig. 9

BACKPACK WITH IMPROVED COMFORT STRUCTURE

RELATED APPLICATION

This application is a continuation-in-part of my copending U.S. application Ser. No. 06/273,258, filed June 12, 1981 entitled "Backpack With Improved Comfort Structure", now abandoned.

BACKGROUND AND SUMMARY OF THE INVENTION

This invention relates to a backpack with improved comfort structure.

In recent years, backpacking has become a very popular activity, not only by professional hikers but also by amateurs as well. Depending upon a person's physical condition and determination, the activity can be carried on along wooded trails, over gently rolling terrain or even in mountainous areas.

It is important that the backpack, which carries within it the hiker's food, clothing and other necessary supplies, be as comfortable as possible for the hiker to carry. Furthermore, it is a desirable feature for the backpack to provide assistance in the event the hiker wishes to rest from time to time, such as at a campsite.

It has previously been proposed to provide a campstool or the like which can be attached to a backpack and which is openable so that the hiker may rest thereon. It has also been proposed to provide special flex joints in the upper siderail portions of the backpack frame to allow the frame to adjust to the shoulder area of the body.

Backpacks have preferably been loaded with the heaviest items closest to the body and the lightest items farthest from the body to keep the greatest weight as close to the center of gravity as possible. Unfortunately, many people do not load their backpacks in this manner, or the pack contents may shift during hiking. This results in a rearward pulling force on the body and a downward sagging of the pack which increases the effort required in climbing inclined paths, thus needlessly tiring the hiker.

The present invention is directed to a backpack which has built thereinto a number of improvements for increasing the comfort of the hiker and lessening his or her tendency to tire.

In accordance with the concepts of the invention, the backpack frame siderails form a pair of legs which in turn pivotally support a pair of supplemental legs. The two pair of legs are provided with feet, and when the leg pairs are pivotally opened, a chair is formed. A suitable flexible seat is disposed between the legs and is mounted at each end to cross-bars joining the two leg pairs.

The two pivotally mounted legs on each side of the chair are joined by connector elements which provide for a plurality of adjustments of the distance between the front and rear feet. By suitably adjusting the connector elements, the chair may be positioned anywhere from generally upright to a generally prone position.

The pack body is joined to the top cross-bar which joins the main frame siderails. When the device is pivoted to the prone chair position, the pack body is hinged rearwardly on the cross-bar so that its bottom end rests on the ground. The top end of the pack body then is disposed outwardly from the cross-bar to form a pillow for the user. An auxiliary pillow may be attached adjacent the top end of the pack body, and which is swingable forwardly to between the cross-bar and the hiker's head for protective purposes and as a head support during actual hiking.

The connector elements may remain joined between the side legs when the device is collapsed. A pack body support extends transversely between and may be joined to the connector elements or the supplemental legs. The support extends behind or through the upper rear portion of the pack body, farthest from the hiker's body, and transfers rearwardly and downwardly directed load forces in that area to the hiker's hips. A second transverse support may extend between the connector elements upon which the bottom end of the pack body rests.

The connector elements furthermore provide for pivoting adjustment of the collapsed device to compensate for a change in load during hiking so that the frame more nearly conforms to the hiker's body.

BRIEF DESCRIPTION OF THE DRAWINGS

The accompanying drawings illustrate the best mode presently contemplated by the inventor for carrying out the invention.

In the drawings:

FIG. 5 is a fragmentary side elevation of the hiker carrying the backpack and which incorporates an auxiliary pillow used as a head protector and support;

FIG. 6 is a fragmentary side elevation showing the auxiliary pillow in use when the converted backpack is in the prone chair position;

FIG. 7 is a rear elevation of the collapsed backpack;

FIG. 8 is a view similar to FIG. 2 and showing adjustment of a backpack frame to the hiker's body; and FIG. 9 is an enlarged fragmentary view of a connection between one end of the supplemental frame and a connector.

DESCRIPTION OF THE PREFERRED EMBODIMENT

Figure 1:
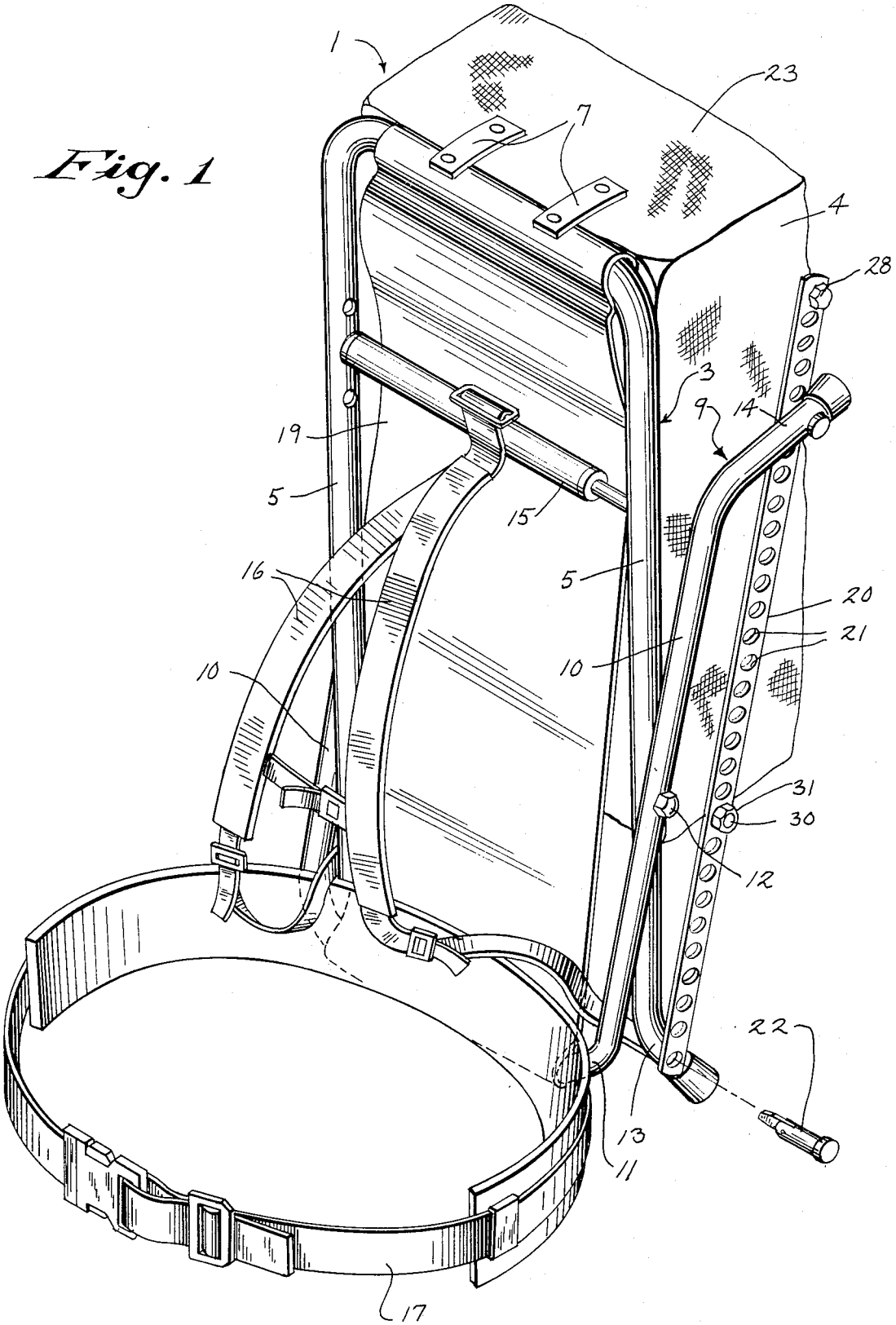
FIG. 1 is a front perspective view of a backpack constructed in accordance with the concepts of the invention.

As shown in the drawings, the backpack 1 of the invention is adapted for use by a hiker 2. Backpack 1 generally comprises a conventional primary frame 3 on the rear side of which is secured a pack body 4.

Frame 3 comprises a generally rectangular tubular member of lightweight aluminum or the like having a pair of spaced downwardly extending siderails 5 which are joined at their upper ends by a cross-bar 6. Suitable straps 7 join the unner end portion of pack body 4 to cross-bar 6, and the lower end portion of pack body 4 is secured to siderails 4, as by snap clips 8.

Figure 2:
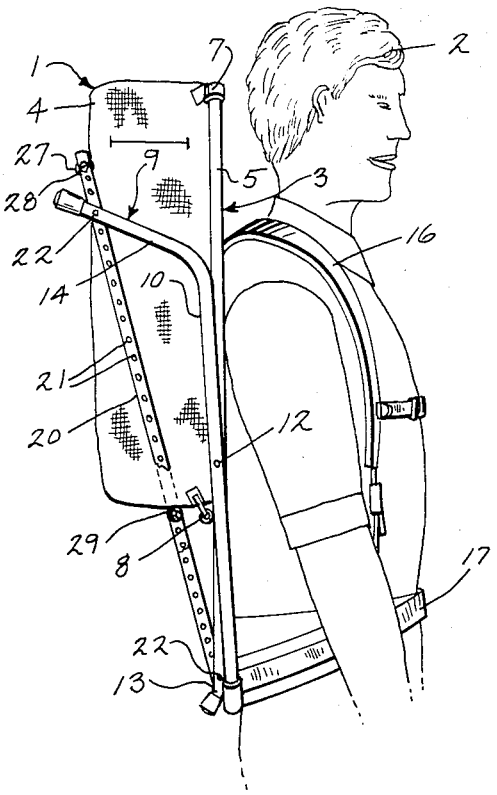
FIG. 2 is a side elevation of a hiker carrying a backpack constructed in accordance with the concepts of the invention.
Figure 3:
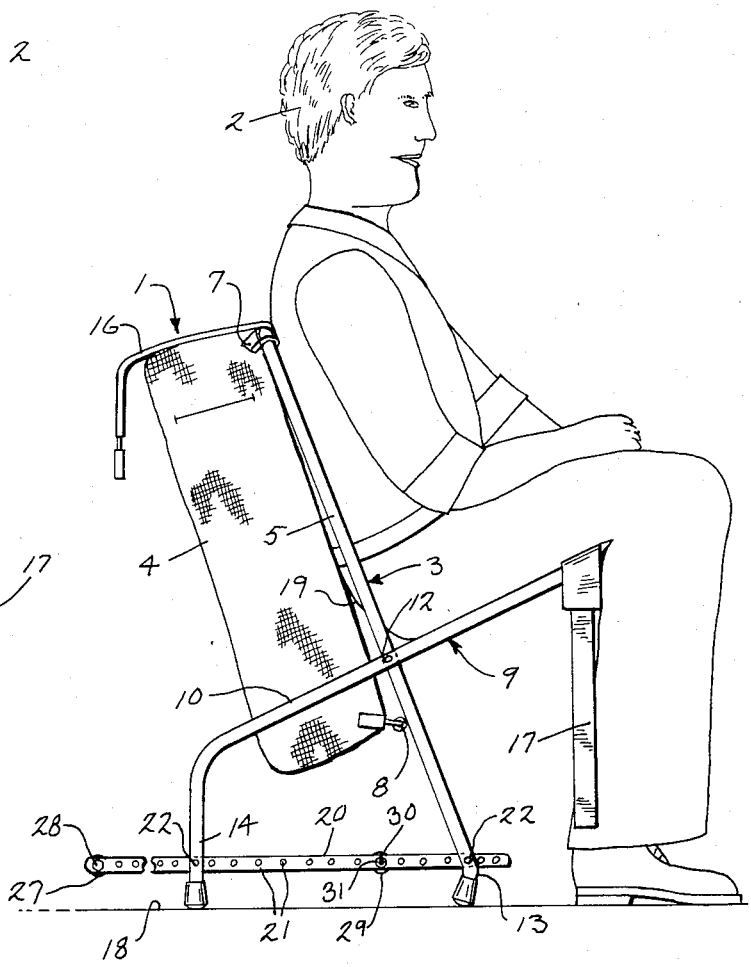
FIG. 3 is a side elevation showing the backpack converted into a generally upright chair.

Backpack 1 is normally adapted to be carried vertically on the back of hiker 2 during hiking, as shown in FIG. 2. However, there will be times when hiker 2 wishes to rest. To assist in this desire, backpack 1 is convertible into a chair. For this purpose, a supplemental frame 9 is provided and which also comprises a generally rectangular tubular member of lightweight aluminum or the like having a pair of upwardly extending siderails or legs 10 which are joined at their lower ends by a cross-bar 11. Legs 10 are spaced apart a distance slightly greater than siderails 5 and their midportions are pivotally mounted to and outwardly of the midportions of their respective adjacent siderails 5, as at 12 so that legs 10 straddle the outer sides of siderails 5 when the legs 10 are in the vertical position shown in FIG. 2. The lower ends of siderails 5 and the upper ends of legs 10 remote from the cross-bars are formed into angularly bent foot portions 13 and 14 respectively. The bent foot portions 14 of legs 10 are integral with and extend at an obtuse angle relative to the rectilinear main body portions of legs 10 so that when the legs 10 are pivoted about pivots 12 in a counterclockwise direction (as viewed in FIG. 2), the foot portions 14 will extend generally vertically and engage the ground as shown in FIG. 3. The aforementioned angular orientation of foot portions 14 allows the legs 10 to withstand the load of a person seated on the supplemental frame (as illustrated in FIG. 3 and as will be described further below) without requiring the legs 10 to be specifically reinforced or made with heavy gauge stock that would undesirably increase the weight of the load carried by the user. Additionally, the angular orientation of foot portions 14 shortens the net length of the legs providing a compact arrangement shown in FIG. 2.

Primary frame 3 and supplemental frame 9 cooperate in anchoring the harness elements for backpack 1. For this purpose, a removable and adjustable rod 15 extends between siderails 5, with shoulder straps 16 being connected to rod 15 and extending upwardly and over the hiker's shoulders, and hence downwardly to an openable hip belt 17 which may be attached to cross-bar 11 as shown in FIG. 1 or alternatively, to the lower end portions of side rails 5 in a manner not shown in the drawings. Suitable buckles may be used in the harness connections.

When hiker 2 desires to rest, he removes the harness from his body and pivots frames 3 and 9 about pivot 12 so that the assembly opens into a chair, as shown in FIG. 3, with foot portions 13 and 14 resting on the ground 18. Note that in the foregoing movement, the portions of legs 10 located above pivots 12 when in the position of FIG. 2 move rearwardly and downwardly (counterclockwise in FIG. 2) relative to the pack frame while the portions of legs 10 located below pivots 12 move forwardly and upwardly relative to the pack frame to form a seat frame projecting from the pack frame at an angle thereto as shown in FIG. 3. A flexible seat 19 having end portions connected to cross-bars 6 and 11 provides suitable support for hiker 2 when he sits.

Connector elements are provided for joining the adjacent siderails 5 and legs 10 on each side of backpack 1 in both its open and collapsed positions. In the present embodiment, the connector elements comprise elongated rigid brackets 20 having a plurality of openings 21 spaced along their length. Each bracket 20 is adapted to join a side pair of siderails 5 and legs 10, as by removable clip pins 22 which extend through the respective foot portions 13, 14 and openings 21.

When backpack 1 is collapsed as shown in FIG. 2, brackets 20 form brace means to hold supplemental frame 9 in relatively fixed position relative to and generally parallel to primary frame 3. The relative positions can be selectively adjusted by connecting clip pins 22 through different desired openings 21 in brackets 20.

When backpack 1 is extended open, the orientation of the chair can be selectively adjusted by connecting pins 22 through different openings 21. As shown in FIG. 3, the bracket connections are such as to provide a generally upright chair. By using different connection points to thereby effectively lengthen the fixed connector between foot portions 13 and 14, the chair can be pivoted further open to a more horizontal or prone position, as shown in FIG. 4.

Although not shown, the connector elements may be provided by flexible straps rather than the rigid brackets 20. The length of the straps could be adjustable and the straps could be removably attached to either or both of the siderails 5 and legs 10.

Figure 4:
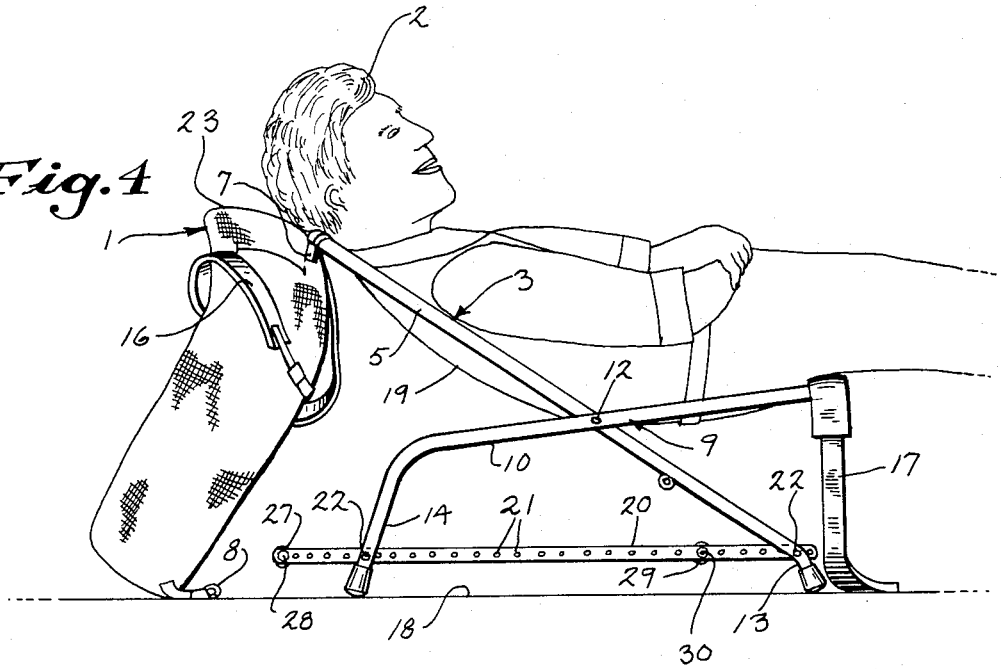
FIG. 4 is a view similar to FIG. 3 and showing the generally prone position of the chair.

In the position of FIG. 4, lower snap clips 8 can be disconnected from siderails 5 and pack body 4 swung rearwardly on straps 7 about cross-bar 6. The bottom end portion of pack body 4 is then rested on ground 18 with the upper end portion thereof disposed outwardly of cross-bar 6 to form a resilient pillow portion 23 for hiker 2 to rest his or her head on.

Referring to FIGS. 5–7, an auxiliary cushion 24 may be disposed adjacent the upper end of pack body 4. In the present embodiment, cushion 24 is removably attached to the top of pack body 4 by flexible strap 25 and snaps 26. During hiking, as in FIG. 5, cushion 24 hangs downwardly between cross-bar 6 and the hiker's head, to form a protective buffer and head support for the latter. When backpack 1 is to be used as a prone chair, cushion 24 is swingable rearwardly on its straps 25 (shown in phantom in FIG. 5) so that it forms an auxiliary pillow for the reclining hiker as shown in FIG. 6.

In this embodiment, connector brackets 20 also function to carry a substantial portion of the weight of pack body 4 downwardly to the hiker's hips. For this purpose, and as best shown in FIGS. 2, 7 and 8, means are provided to support the upper rear portion of pack body 4, and to support the bottom end of body 4.

As shown, brackets 20 extend outwardly beyond the connection to foot portions 14 and mount a removable transverse rod-like support 27 which in this embodiment extends across the rear portion of pack body 4. Support 27 may be connected to desired openings 21 as by threaded bolts 28. A spare clip 28A is secured to the rear face of pack body 4 and is attached between the ends of support 27. Rearward or sagging loads in the upper portion of pack body 4 which are spaced a substantial distance from the hiker's back will be transferred to the hips via clip 28A, support 27, diagonal brackets 20, legs 10 and hip belt 17.

Alternatively, support 27 could connect between foot elements 14 and/or pass through pack body 4.

Likewise, a transverse rod-like support 29 is disposed just beneath pack body 4 to support the bottom of the latter. Support 29 is shown as having threaded end portions 30 which extend through the desired openings 21, with nuts 31 threaded thereonto. The bottom load is thus transferred to the hips via support 29, diagonal brackets 20, legs 10 and hip belt 17.

As pointed out previously, brackets 20 are such that when backpack 1 is in collapsed hiking position, the positions of frames 3 and 9 can be relatively adjusted. It is desirable to have the backpack framework hug the back of the hiker as close as possible. Depending upon the weight and placement of the load within pack body 4, the framework may tend to pull away from some portion of the hiker's back. FIG. 8 illustrates several adjusted positions of frame 3 for compensating for the said load change. For added comfort, siderails 5 and legs 10 are shown in this Figure as slightly S-shaped to more fully conform to the natural contour of the back. If desired, and to provide some slack in the adjusted position of the backpack during walking, the openings 21A in both ends of brackets 20 may be slotted slightly, as in FIG. 9, to permit the device to give more freely relative to the moving hiker.

The backpack of the invention provides a substantial improvement over prior known devices of this type. It is relatively inexpensive to manufacture and maintain, and adds to the comfort and convenience of the user; and yet without impairing the ability of the pack frame to function to carry the load of the backpack in normal manner and without adversely shifting or increasing the load of the backpack. Also, the structure may be quickly and easily converted into a reclining or seating mode without the need of removing the backpack.

Various modes of carrying out the invention are contemplated as being within the scope of the following claims particularly pointing out and distinctly claiming the subject matter which is regarded as the invention.

What is claimed is:

1. A backpack frame for hikers and the like, comprising in combination:

(a) a primary frame having a pair of spaced generally parallel siderails joined at their upper and end portions by a cross-bar, (b) said primary frame adapted to support a pack body secured to the rear side of said primary frame, (e) a supplemental frame disposed adjacent said primary frame and having a pair of spaced generally parallel legs joined at their lower end portions of a cross-bar and being positioned outwardly of said siderails, (d) pivot means pivotally joining intermediate portions of said siderails and legs on each side thereof for movement between collapsed generally vertical positions for hiking and extended open positions forming a chair, portions of said legs located above said pivot means when in the closed position being movable about said pivot means rearwardly of said primary frame into said open position for engagement with a ground surface portions of said siderails located below said pivot means being engageable with the ground surface at locations forwardly of said leg portions, and portions of said legs located below said pivot means when in the closed position being movable about said pivot means forwardly of said primary frame into said open position projecting from the plane of said primary frame to form a seat frame, (e) and means for connecting said primary and supplemental frames below said pivot means in said open positions thereof, and wherein said legs have main body portions and foot portions located at ends opposite the cross-bar, said foot portions extending at an angle relative to said main body portions such that when the legs are in said open position the portions extend generally vertically for engaging the ground.

2. The backpack frame defined in claim 1 wherein said foot portions extend at an obtuse angle relative to the main body portions of said legs.

3. The backpack frame defined in claim 2 wherein said foot portions are bent portions integral with the main body portions of the legs.

4. A backpack frame for hikers and the like, comprising in combination:

(a) a primary frame having a pair of spaced generally parallel siderails joined at their upper and end portions by a cross-bar, (b) said primary frame adapted to support a pack body secured to the rear side of said primary frame, (c) a supplemental frame disposed adjacent said primary frame and having a pair of spaced generally parallel legs joined at their lower end portions by a cross-bar and being positioned outwardly of said siderails, (d) pivot means pivotally joining intermediate portions of said siderails and legs on each side thereof for movement between collapsed generally vertical positions for hiking and extended open positions forming a chair, portions of said legs located above said pivot means when in the closed position being movable about said pivot means rearwardly of said primary frame into said open position for engagement with a ground surface, portions of said siderails located below said pivot means being engageable with the ground surface at locations forwardly of said leg portions, and portions of said legs located below said pivot means when in the closed position being movable about said pivot means forwardly of said primary frame into said open position projecting from the plane of said primary frame to form a seat frame, (e) and means for connecting said primary and supplemental frames below said pivot means in said open positions thereof, and wherein said means for connecting said primary and supplemental frames includes connector elements and means releasably connecting said connector elements to said primary and supplemental frames on each of their sides below said pivot means, and wherein said legs have main body portions and foot portions located at ends opposite the cross-bar, said foot portions extending at an obtuse angle relative to said main body portions said that when the legs are in said open positions the foot portions extend generally vertically for engaging the ground.

5. The backpack frame defined in claim 4 wherein said foot portions are bent portions integral with the main body portions of the legs.

6. A backpack frame for hikers and the like, comprising in combination:

(a) a primary frame having a pair of spaced generally parallel siderails joined at their upper and end portions by a cross-bar, (b) said primary frame adapted to support a pack body secured to the rear side of said primary frame, (c) a supplemental frame disposed adjacent said primary frame and haing a pair of spaced generally parallel legs joined at their lower end portions by a cross-bar and being positioned outwardly of said siderails, (d) pivot means pivotally joining intermediate portions of said siderails and legs on each side thereof for movement between collapsed generally vertical positions for hiking and extended open positions forming a chair, portions of said legs located above said pivot means when in the closed position being movable about said pivot means rearwardly of said primary frame into said open position for engagement with a ground surface, portions of said siderails located below said pivot means being engageable with the ground surface at locations forwardly of said leg portions, and portions of said legs located below said pivot means when in the closed position being movable about said pivot means forwardly of said primary frame into said open position projecting from the plane of said primary frame to form a seat frame, (e) and means for connecting said primary and supplemental frames below said pivot means in said open positions thereof, and wherein said means for connecting said primary and supplemental frames includes connector elements and means releasably connecting said connector elements to said primary and supplemental frames on each of their sides below said pivot means, and wherein there is further included a hip belt connected to lower portions of one of said primary and supplemental frames and adapted to be worn on the hips of a user of the backpack frame to transfer loads from the backpack frame to the hips of the user, and wherein said legs have main body portions and foot portions located at ends opposite the cross-bar, said foot portions extending at an obtuse angle relative to said main body portions such that when the legs are in said open positions the foot portions extend generally vertically for engaging the ground and wherein said foot portions are bent portions integral with the main body portions of the legs.

* * * * *